US006286400B1

(12) United States Patent
Anderson et al.

(10) Patent No.: US 6,286,400 B1
(45) **Date of Patent: *Sep. 11, 2001**

(54) ELECTRICAL INSTALLER PUTTY-FILLED SCREW HOLE CLEARING 10-IN-1 DRIVING TOOL

(76) Inventors: Wayne Anderson, 65 Grove St.; Paolo Cassutti, 8 N. Creek Rd., both of Northport, NY (US) 11768

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/489,487

(22) Filed: Jan. 21, 2000

Related U.S. Application Data

(63) Continuation-in-part of application No. 09/168,637, filed on Oct. 8, 1998, which is a continuation-in-part of application No. 08/977,453, filed on Nov. 24, 1997, now Pat. No. 5,904,080, which is a continuation-in-part of application No. 08/620,471, filed on Mar. 22, 1996, now abandoned, application No. 09/489,487, which is a continuation-in-part of application No. 08/960,090, filed on Oct. 24, 1997, now Pat. No. 5,819,612, which is a continuation of application No. 08/608,195, filed on Feb. 28, 1996, now abandoned, said application No. 08/960,090, is a continuation-in-part of application No. 08/846,070, filed on Apr. 25, 1997, now Pat. No. 5,868,048.

(51) Int. Cl.[7] ..... B25B 23/00
(52) U.S. Cl. ..... 81/439; 81/436; 7/165
(58) Field of Search ..... 81/436, 439; 7/165

(56) References Cited

U.S. PATENT DOCUMENTS

| | | | | |
|---|---|---|---|---|
| 5,533,429 | * | 7/1996 | Kozak | 81/439 |
| 5,785,468 | * | 7/1998 | Peritz | 7/165 X |
| 5,904,080 | * | 5/1999 | Anderson et al. | 81/439 |
| 5,954,463 | * | 9/1999 | Jore | 81/439 X |

* cited by examiner

*Primary Examiner*—James G. Smith
(74) *Attorney, Agent, or Firm*—Lackenbach Siegel Marzullo Aronson & Greenspan

(57) ABSTRACT

An electrical installer hand tool has multiple interchangeable rethread bits and drive bits in the one hand tool. The 10-in-1 hand tool optimally has 4 interchangeable rethread bits, 4 interchangeable drive bits and 2 nut drives. The 4 rethread bits optimally has size/number of threads, 6/32, 8/32, 10/32 and 10/24, and the 4 drive bits are correspondingly sized to drive screws in the rethreaded holes. The 10-in-1 hand tool permits an electrical installer to rethread putty-filled screw holes and then drive screws in the electrical box sheet metal construction with the one hand tool.

9 Claims, 2 Drawing Sheets

20
124
126
116
112
128
21
19
18
25
150
160
135

ELECTRICAL INSTALLER PUTTY-FILLED SCREW HOLE CLEARING 10-IN-1 DRIVING TOOL

PRIOR RELATED APPLICATIONS

This application is a continuation-in-part of Ser. No. 09/168,637, filed Oct. 8, 1998 which is a continuation-in-part of Ser. No. 08/977,453, filed Nov. 24, 1997, now U.S. Pat. No. 5,904,080, issued May 18, 1999, which is a continuation of 08/620,471, filed Mar. 22, 1996 now abandoned, application Ser. No. 09/489,487 which is a continuation-in-part application of Ser. No. 08/960,090, filed Oct. 24, 1997, now U.S. Pat. No. 5,819,612, issued Oct. 13, 1998, which was a continuation of Ser. No. 08/608,195, filed Feb. 28, 1996 now abandoned, and a continuation-in-part application of Ser. No. 08/846,070, filed Apr. 25, 1997, now U.S. Pat. No. 5,868,048, issued Feb. 9, 1999.

FIELD OF THE INVENTION

This invention relates to an electrical installer hand tool. Specifically this invention relates to a hand tool for electrical installer sheet metal work. More specifically this invention relates to electrical installer tools for rethreading putty or like gunk-filled screw holes, and driving screws into the cleared holes.

BACKGROUND OF THE INVENTION AND DISCUSSION OF THE PRIOR ART

Electrical installers work on sheet metal construction such as electrical boxes and are required to drive screws in pre-threaded screw holes in the sheet metal construction. The drywall construction putty however often plugged the screw holes. The screw holes might also be paint-filled or otherwise gunk-filled. The electrical worker must then first rethread the screw holes. Further, the electrical worker may only carry screws of a larger size than the pre-threaded screw hole, and must then tap a larger hole. These impediments required the electrical installer to carry several tools including screwdrivers, rethreaders and tapping tools.

It was also known in the electrical installer's art to use a "Tri-tap" which was a hand tool having three increasingly sized tapping heads integrally formed at the distal end. It was also known to provide loose tapping bits for assembly in a drive chuck or in a receiving end of a hand tool. The electrical installer also carried screwdrivers and nut drivers for electrical field commonly sized screws and nuts. The electrical installer desired a more practical and efficient solution.

SUMMARY OF THE INVENTION

The terms "rethread bit" and or "tap bit" as used hereinbefore and hereinafter throughout the specification and claims are understood to mean a tool bit which is capable of clearing and or enlarging a pre-threaded screw hole.

The term "tool bit" or "tool bits" as used hereinbefore and hereinafter throughout the specification and claims is understood to be generic to a "drive bit" for driving a screw or like fastener and is also generic to a "rethread bit" or "tap bit" as above-defined.

The terms "correspondingly sized drive bit" as used hereinbefore and hereinafter throughout the specification and claims means a drive bit sized to drive a screw configured and sized for the screw hole cleared by the rethread bit.

The present invention provides a single 10-in-1 hand tool that provides the electrical installer with the requisite rethreading, tapping, screw drive and nut drive configurations. The present single hand tool provides a plurality of rethreading or retapping and or driving functions, thereby eliminating the need for an electrical installer to carry several hand tools.

The hand tool, in one aspect, provides 10-in-1 interchangeable tool bit drives and nut drives specially configured for electrical installer operations. The hand tool has, in addition to a handle, three unitary one-piece housing sleeves, including one master sleeve with oppositely disposed hexagonal ends and cavities which are sized to receive two inner hexagonal sleeves. A plurality of double-ended tool bits of rethread bit and drive bit configurations are slidably non-rotatably disposed in the oppositely disposed hexagonal cavities and ends of the inner hexagonal sleeves. In use, the hand tool with a selected rethread bit operably disposed rethreads or clears putty-filled screw holes in a sheet metal construction such as an electrical box, and then interchangeable uses a drive bit to drive a screw through the cleared hole.

The hand tool optimally provides 4 rethread bits of "size/number of threads", as follows: 6/32, 8/32, 10/32 and 10/24, and 4 correspondingly usefully sized drive bits. This combination of rethread and drive bits provides the electrical installer with practically speaking essentially all requisite rethread and screw drive functions.

DESCRIPTION OF THE PREFERRED EMBODIMENTS

Applicants hereby incorporate herein by reference thereto the disclosure of their application Ser. No. 09/168,637, filed Oct. 8, 1998, now U.S. Pat. No. 6,209,428.

Figure 1:
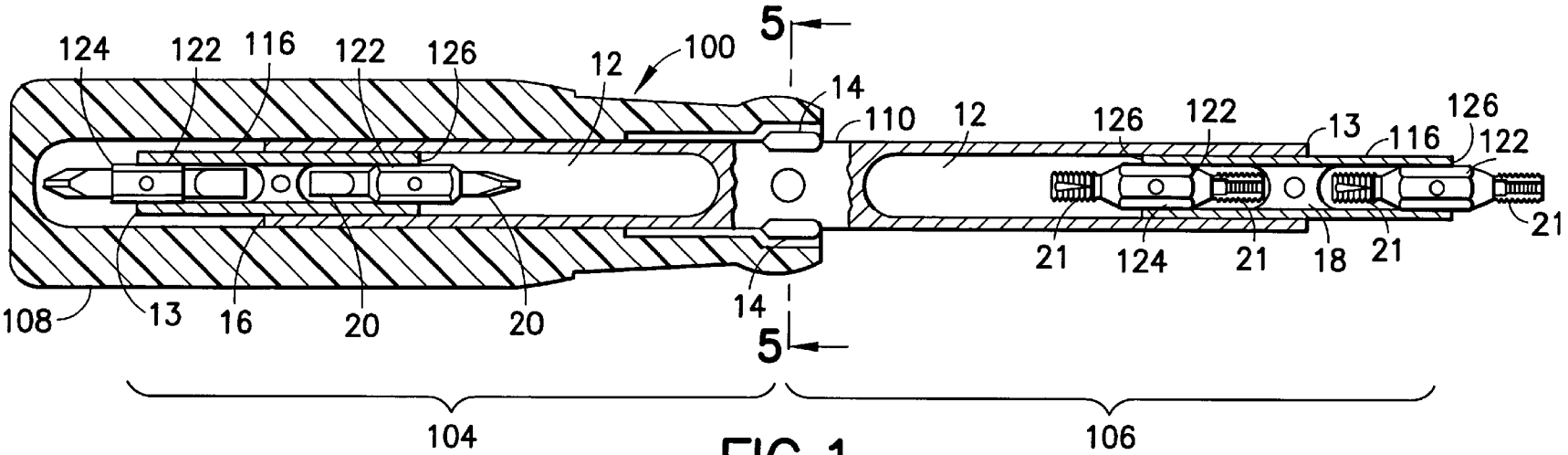
FIG. 1 is a partial sectional view of the band tool of the present invention.
Figure 3:
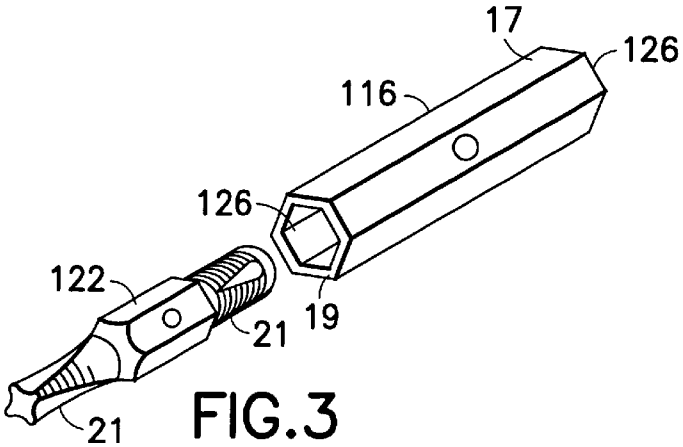
FIG. 3 is a perspective view of a tool bit with rethread bits being inserted into one of the housing sleeves.
Figure 5:
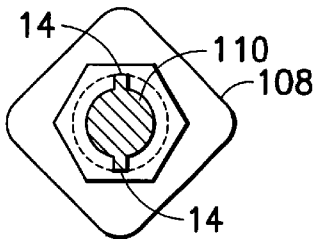
FIG. 5 is a sectional view taken along line 5—5 of FIG. 1.

Referring to the FIGS., there is shown 10-in-1 hand tool 100. Hand tool 100 has a proximate portion 104 and a distal portion 106. Hand tool 100 includes a master or first cylindrical housing 112 formed of drawn unitary one-piece steel construction having an integral central wall 110 and oppositely disposed hexagonal cavities 12 with hexagonal ends or end portions 13, for purposes hereinafter appearing. A pair of ears 14 are formed on housing 112 at central wall 40 to non-rotatably retain housing 112 in plastic handle 108 (FIGS. 1 and 5).

A pair of second housings 116 are provided which have outer hexagonal surface 17 for slidably non-rotatably insertion into the respective hexagonal cavities 126 of first housing 112. Housing 116 is formed of drawn unitary one-piece steel construction having an integral central wall 18 and oppositely disposed hexagonal ends or end portions 19, for purposes hereinafter appearing.

A plurality of 4 double-ended tool bits 124 are provided having either a drive bit 20 or a rethread bit 21 formed at one of the oppositely disposed ends of hexagonal body portion 122 (typical). Tool bit hexagonal body portion 122 is sized to be slidably non-rotatably received in hexagonal cavities 126. First housing hexagonal ends 13 and second housing hexagonal ends 19, without the tool bits, function as differently sized nut drivers.

Figures 2, 4A, 4B, 4C, 4D:
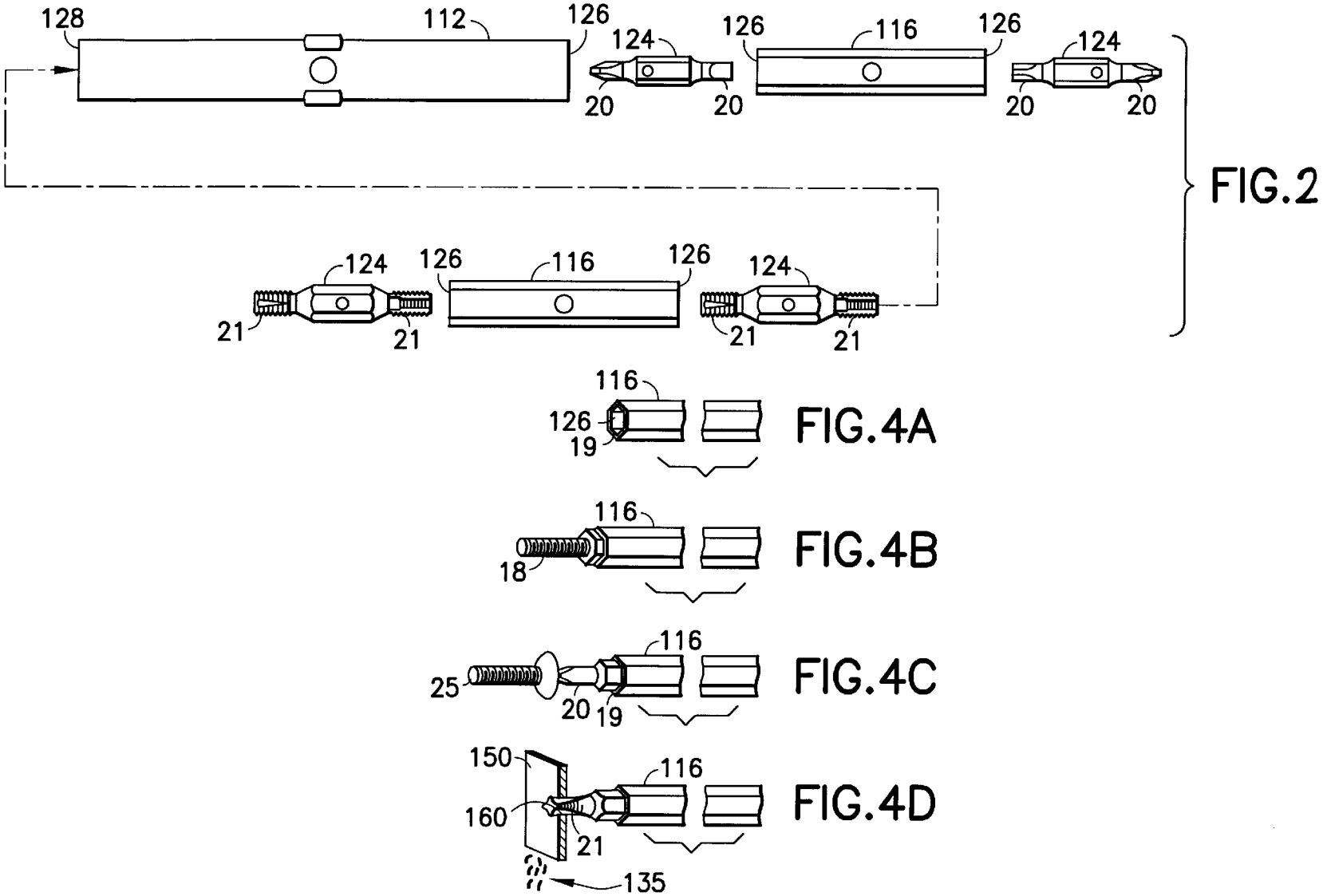
FIG. 2 is an exploded assembly view of the housing and tool bits of the hand tool of FIG. 1.
FIG. 4A is a perspective view of the inner housing sleeve end.
FIG.4B is a perspective view of the inner housing sleeve end of FIG. 4A engaging a hexagonal bolt head or nut.
FIG. 4C is a perspective view of the inner housing sleeve end of FIG. 4A with an inserted drive bit engaging a Phillips head screw.
FIG. 4D is a perspective view of the inner housing sleeve end of FIG. 4A with an inserted rethread bit clearing a putty-filled screw hole in a sheet metal construction.

Referring to FIGS. 4A and 4B there is shown the hexagonal end 19 without a tool bit (FIG. 4A) and in use as a hex head bolt 18 or a nut driver (FIG. 4B). FIG. 4C shows hexagonal end 19 of second housing 116 with drive bit body 122 slidably non-rotatably received in end, and with drive bit 20 engaging screw 25 for screwdriver use. FIG. 4D shows hexagonal end 19 of second housing 116 with rethread bit 21 of body 112 slidably non-rotatably received in cavity 126 for rethread use. Specifically, rethread bit 21 is shown clearing the falling putty 135 out of a screw hole 160 in a electrical sheet metal 150 construction.

In the aforesaid manner of construction, the hand tool 100 provides 10-in-1 functionality with a three one-piece unitary housing construction, and optimally provides the electrical installer with 4 rethread functions, 4 screw drive functions and 2 or more nut drive functions.

It was determined that 4 rethread bits of size/number of threads, viz. 6/32, 8/32, 10/32 and 10/24, with 4 correspondingly sized screw drive bits is an optimal configuration for an electrical installer. That is, that 4 rethread bits/4 screw drive bit configuration provides essentially all the practically useful electrical installation rethread and screw drive functions in a single tool. Additional or alternate screw bit drives however may be included such as shown and described in U.S. Pat. No. 5,904,080.

While only a few preferred embodiments of the invention have been described hereinabove, those of ordinary skill in the art will recognize that the embodiment may be modified and altered without departing from the central spirit and scope ofthe invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed:

1. An electrical installer hand tool comprising;

a handle;

first tool bit members, each first member being formed with oppositely disposed tool bits, wherein at least one tool bit of each said first member is a rethread bit;

second tool bit members, each second member being formed with oppositely disposed tool bits, wherein at least one tool bit of each said second member is a drive bit;

a shank, said shank having a proximate end and a distal end, said shank comprising means for removably non-rotatably holding said shank proximate end in said handle, said shank comprises a unitary one-piece first cylindrical housing having oppositely disposed open ends and two unitary one-piece second cylindrical housings having oppositely disposed open ends, each said second housing being slidably non-rotatably received in the respective opposite ends of the first housing said first tool bit member being slidably disposed in one second housing end, and said second tool bit member being slidably disposed in said other second housing end, whereby each tool bit is alternatively operably disposed in the distal end of the shank.

2. The electrical installer hand tool of claim 1, where each end of each first member is formed with a rethread bit, and each end of each second member is formed with a drive bit.

3. The hand tool of claim 1, each said drive bit corresponds in size to one said rethread bit so that in rethreading a hole the correspondingly sized drive bit is alternatively operably disposed in the shank to drive a correspondingly sized screw in said rethreaded hole.

4. The hand tool of claim 1, each said housing open end being formed with a non-circular nut drive.

5. The hand tool of claim 1, at least one said first housing open end being formed with a first nut drive and at least one said second housing open end being formed with a second differently sized nut drive.

6. The hand tool of claim 1, said four rethread bits having respective rethread bits size/number of threads of 6/32, 8/32, 10/32 and 10/24.

7. A hand tool comprising:

a handle;

first integral double-ended tool bit members;

second integral double-ended tool bit members;

a shank having a proximate end disposed in the handle and a distal end, said shank comprising means for removably holding said first integral double-ended tool bit members and said second integral double-ended tool bit members comprising a unitary one-piece first cylindrical housing having oppositely disposed ends, a second unitary one-piece cylindrical housing having oppositely disposed ends for removably holding said first integral double-ended tool bit members, said second housing being slidably received in one said end of the first housing, said first integral double-ended tool bit members being slidably received in said second housing ends, a third unitary one-piece cylindrical housing having oppositely disposed ends for removably holding said second integral double-ended tool bit members, said third housing being slidably received in the other end of the first housing, said second integral double-ended tool bit members being slidably received in the third housing ends, wherein one tool bit member is operably disposed in the distal end of the shank.

8. The hand tool of claim 7, said first integral double-ended tool bit members having oppositely disposed first bits.

9. The hand tool of claim 7, said second integral double-ended tool bit members each having oppositely disposed drive bits.

* * * * *